US005290039A

United States Patent [19]

Cornelio

[11] Patent Number: 5,290,039

[45] Date of Patent: Mar. 1, 1994

[54] BALL THROWING AND CATCHING SCOOP

[76] Inventor: Julius B. Cornelio, 143 Hilltop Dr., Vallejo, Calif. 94591

[21] Appl. No.: 933,349

[22] Filed: Aug. 21, 1992

[51] Int. Cl.[5] ..... A63B 59/02

[52] U.S. Cl. ..... 273/326

[58] Field of Search ..... 273/326, 67 R, 318, 273/319, 320, 321, 322, 323, 328

[56] References Cited

U.S. PATENT DOCUMENTS

| | | | |
|---|---|---|---|
| 1,022,186 | 4/1912 | Engler | 273/322 |
| 2,029,790 | 2/1936 | Philipp | 273/326 |
| 3,115,129 | 12/1963 | Merriman | 273/323 X |
| 3,170,688 | 2/1965 | Porter | 273/326 X |
| 3,392,978 | 7/1968 | Wiest, Jr. | 273/322 |
| 3,697,074 | 10/1972 | Duncan | 273/326 |
| 3,887,184 | 6/1975 | Cavaliere | 273/328 |
| 4,302,017 | 11/1981 | Huqueriza | 273/323 |
| 4,374,590 | 2/1983 | Everlith et al. | 273/326 |
| 4,502,690 | 3/1985 | Ruperto | 273/326 |

*Primary Examiner*—William H. Grieb
*Attorney, Agent, or Firm*—Harold D. Messner

[57] ABSTRACT

An unitary ball hurling and catching scoop is described comprising crescent-shaped receptacle and handle segments. The receptacle segment includes a remote up-sloped section connected to a pocket section. The pocket section is connected to the handle segment. In shape, the up-sloped and pocket sections are U-shaped in transverse cross section and include a curved floor and a pair of upright side walls terminating in a pair of coextensive and coplanar upper edges. Between the side walls, a longitudinal entryway is formed. The upper edges of the entryway mimic the shape of the inner edge of a crescent and define different depths within the up-sloped and pocket sections wherein the depth values change from a minimum at the up-sloped section to a maximum at the pocket section. The handle segment has a triangular cross section and includes a flat upper surface and a pair of sloped side surfaces oriented with respect to the entryway such that the flat upper surface and the entryway face in a common direction. The user grips the handle segment so as to emulate a throwing motion: his palm is placed along the apex of the sloped side surfaces with the palm and entryway facing in the common direction. The index and middle fingers are placed on opposite sides of the apex. The ends of the remaining thumb and fingers contact the upper surface. In that way, a baseball pitcher's grip on a baseball is emulated wherein the pronation efficiency of the wrist is utilized.

11 Claims, 2 Drawing Sheets

BALL THROWING AND CATCHING SCOOP

SCOPE OF THE INVENTION

This invention relates to a ball hurling and catching scoop for amusement purposes and more particularly to a scoop adapted for use by a player in which his throwing vis-a-vis catching motion is emphasized.

BACKGROUND OF THE INVENTION

Various devices that combine ball throwing and catching capability in a single construction are known to those skilled in the art. In U.S. Pat. No. 3,392,978, a ball can be hurled in the air on a curved trajectory by a device having an arcuate channel that terminates in a tossing end and a catching end. U.S. Pat. No. 3,115,129 discloses a device comprising a cylindrical main body in combination with a hollow handle in which the inside of the main body is provided with ribs which cooperate with a ball having concentric grooves to affect tossing and catching functions. U.S. Pat. No. 3,697,074 shows a bowl-shaped implement having a concave surface and handle. A ball with little elasticity is thrown in the air and caught on the down slope of the curved surface. U.S. Pat. No. 3,887,184 discloses a device having a support, a ball-tossing ramp having side rail, a catching bucket at one end and a handle at the opposite end. U.S. Pat. No. 4,302,017 discloses a device for hurling a ball against a wall and then catching the rebound on a conventional racquetball or handball court. The device includes an elongated body member having an open end and closed end. The side wall of the body member is sliced open along one side to allow egress of the ball but still retains a fully closed end to affect stopping and retaining the ball. Other implements employed to hurl a ball against a wall by one player and caught by an opponent in a game known as Jai-Alai, are likewise known. Such devices are curved and include a tunneled handle with a strap for securing the player's hand to the body of the device.

While the above-described devices have various capability and functions depending primarily upon the nature of the game associated with the devices, none have placed emphasize upon the relationship of the player's grip vis-a-vis the handle and sloped sections to emphasize his throwing vis-a-vis catching motion.

SUMMARY OF THE INVENTION

In accordance with the invention, the present invention includes an unitary ball hurling and catching scoop comprising a crescent-shaped receptacle and handle segments.

The receptacle segment includes a remote up-sloped section connected to an intermediately positioned pocket section. In shape, orientation and construction, the up-sloped and pocket sections are U-shaped in transverse cross section and include a curved floor and a pair of upright side walls terminating in a pair of coextensive and coplanar upper edges. Between the side walls, a continuous longitudinal entryway is formed. The entryway is coplanar of the upper edges of the side walls. The side walls and curved floor of the up-sloped and pocket sections define a series of formation centers. Such centers lie along a longitudinal axis. Between the side walls, the floor defines a nadir region at its interior and an apex region at its exterior—both being concave with respect to entryway. The nadir and apex region—in the transverse direction—are midway between the side walls; in the longitudinal direction, they extend the entire length of the up-sloped and pocket sections, beginning at the up-sloped section at an arcuate tip, then traveling in crescent-like paths to a laterally extending rear edge. The upper edges of the entryway mimicking the shape of the inner edge of a crescent and define different depths within the up-sloped and pocket sections wherein the resulting depth values change from a minimum at the up-sloped section to a maximum at the pocket section.

The handle segment has a triangular cross section and includes an upper substantially flat upper surface and a pair of sloped side surfaces. The surfaces are oriented with respect to the entryway of the receptacle segment such that the flat upper surface and the entryway face in a common direction. An apex of the pair of sloped side surfaces protrudes in an opposite direction.

The user grips the handle segment so as to emulate a throwing motion: his palm is placed so that the apex of the sloped side surfaces is along the longitudinal axis of his hand; the palm and entryway facing in the common direction and the back of his hand facing in the opposite direction. The index and middle fingers are placed on opposite sides of the apex. The ends of the remaining thumb and fingers contact the upper surface. In that way, the grip of a baseball pitcher's fingers on the seams of a baseball is emulated wherein the pronation efficiency of the wrist is utilized to allow the user to throw and catch a ball with increased flexibility and accuracy.

BRIEF DESCRIPTION OF THE DRAWINGS

The invention will now be fully described with reference to the accompanying drawings wherein.

DETAILED DESCRIPTION OF THE INVENTION

Figure 1:
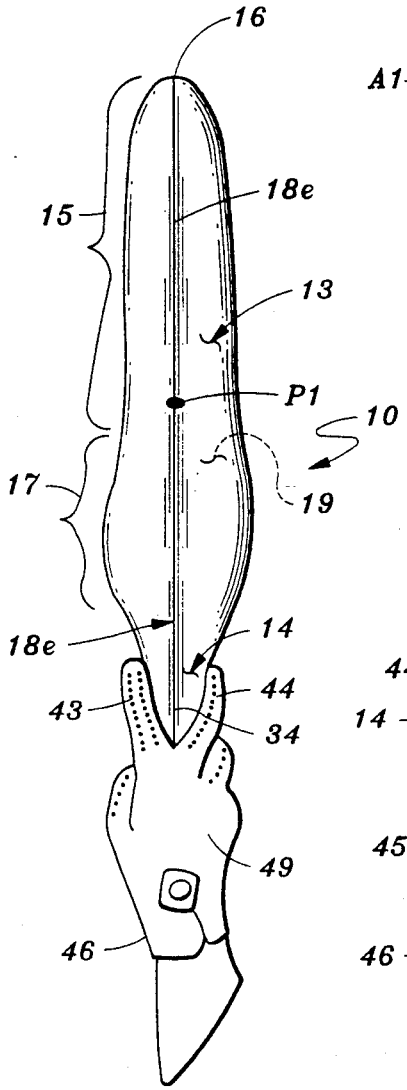
FIG. 1 is a reverse plan view of the scoop of the invention that includes a receptacle segment and a handle segment wherein the dominant, gloved hand of the user is shown in contact with the handle segment to either catch or throw a ball shown within the pocket section of the receptacle segment.
Figure 2:
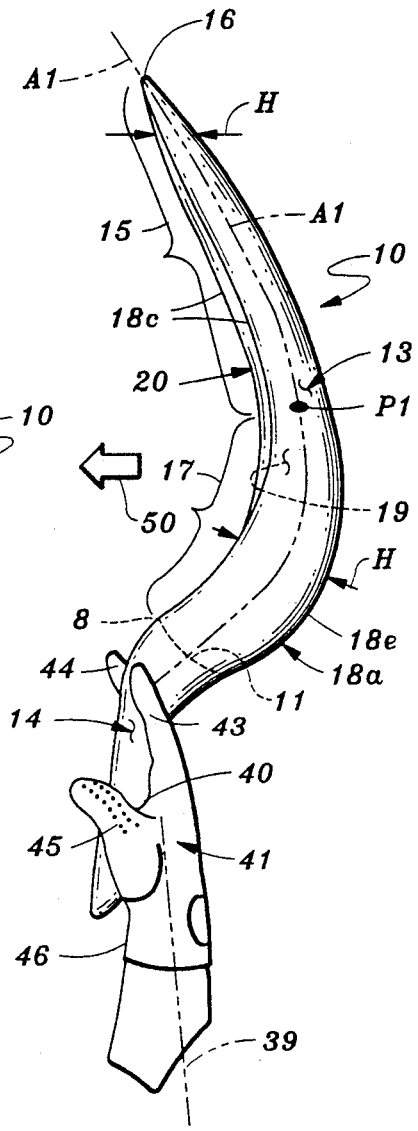
FIG. 2 is a side view of the scoop of FIG. 1 slightly rotated to show the cavity formed within the receptacle segment.
Figure 3:
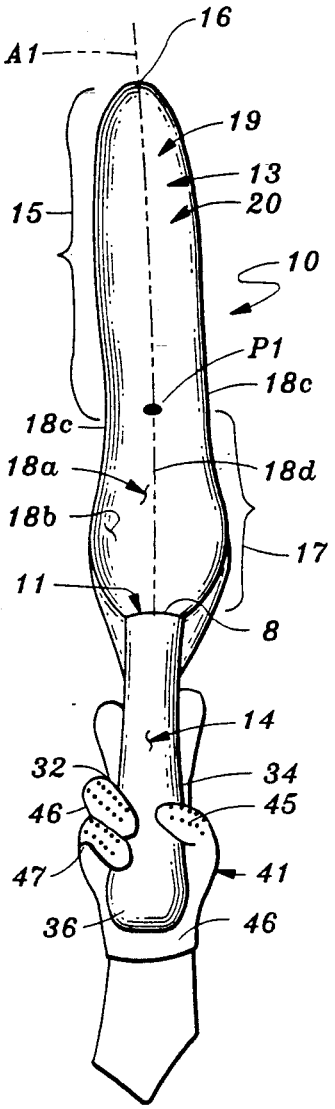
FIG. 3 is a plan view of the scoop of FIG. 1.

Referring now to FIGS. 1-3 wherein similar reference characters designate corresponding elements, the scoop 10 of the invention is illustrated in three views. The scoop 10 comprises a crescent-shaped main receptacle segment 13 and a handle segment 14.

The receptacle segment 13 is U-shaped in cross section and includes an up-sloped section 15 and an pocket section 17 defining a complexly shaped longitudinally extending axis A1 (see FIGS. 1 and 2). Point P1 on the axis A1 marks the demarkation between the up-sloped section 15 and the pocket section 17.

Pocket section 17 is connected to handle segment 14 at arcuate end bulkhead 11.

The construction of the up-sloped section 15 and the pocket section 17 is as follows. Both are closed along a continuous curved floor 18*a*. Transversely projecting side walls 18*b* attach at the ends of the curved floor 18*a* and terminate in a pair of upper edges 18*c*. A cavity portion 19 is formed between the curved floor 18*a* and the side walls 18*b*. Between the side walls 18*b*, the floor 18*a* defines a nadir region 18*d* at its interior and an apex region 18*e* at its exterior—both being concave with respect to entryway 20. The entryway 20 is seen to be coplanar of the upper edges 18*c*.

Nadir and apex regions 18*d*, 18*e*—in the transverse direction—are midway between the side walls 18*b*; in the longitudinal direction, they extend the entire length of the up-sloped and pocket sections 15, 17, beginning at the up-sloped section 17 at an arcuate tip region 16, then traveling in crescent-like paths to a laterally extending upper edge 8 of the bulkhead 11.

Upper edges 18*c* of the entryway 20 mimic the shape of the inner edge of a crescent and define different depths within the up-sloped and pocket sections 15, 17. As a result, depth values within cavity portion 19 change from a minimum at the up-sloped section 15 to a maximum at the pocket section 17.

As seen in FIG. 2, heights H from the upper edges 18*c* to apex region 18*e* of the floor 18*a* change as a function of position along longitudinal axis A1 as explained below. Suffice to say, heights H from the upper edges 18*c* to the apex region 18*e* is maximum in the pocket section 17 and is minimum adjacent to the tip region 16 of the up-sloped section 15.

Orientation, shape and relationship of the floor 18*a*, the side walls 18*b* and upper edges 18*c* are best explained in the capture and manipulation of a ball 9 (within up-slope section 15 and pocket section 17), as depicted in more detail in FIGS. 4–9.

Figures 4, 5, 6, 7, 8, 9:
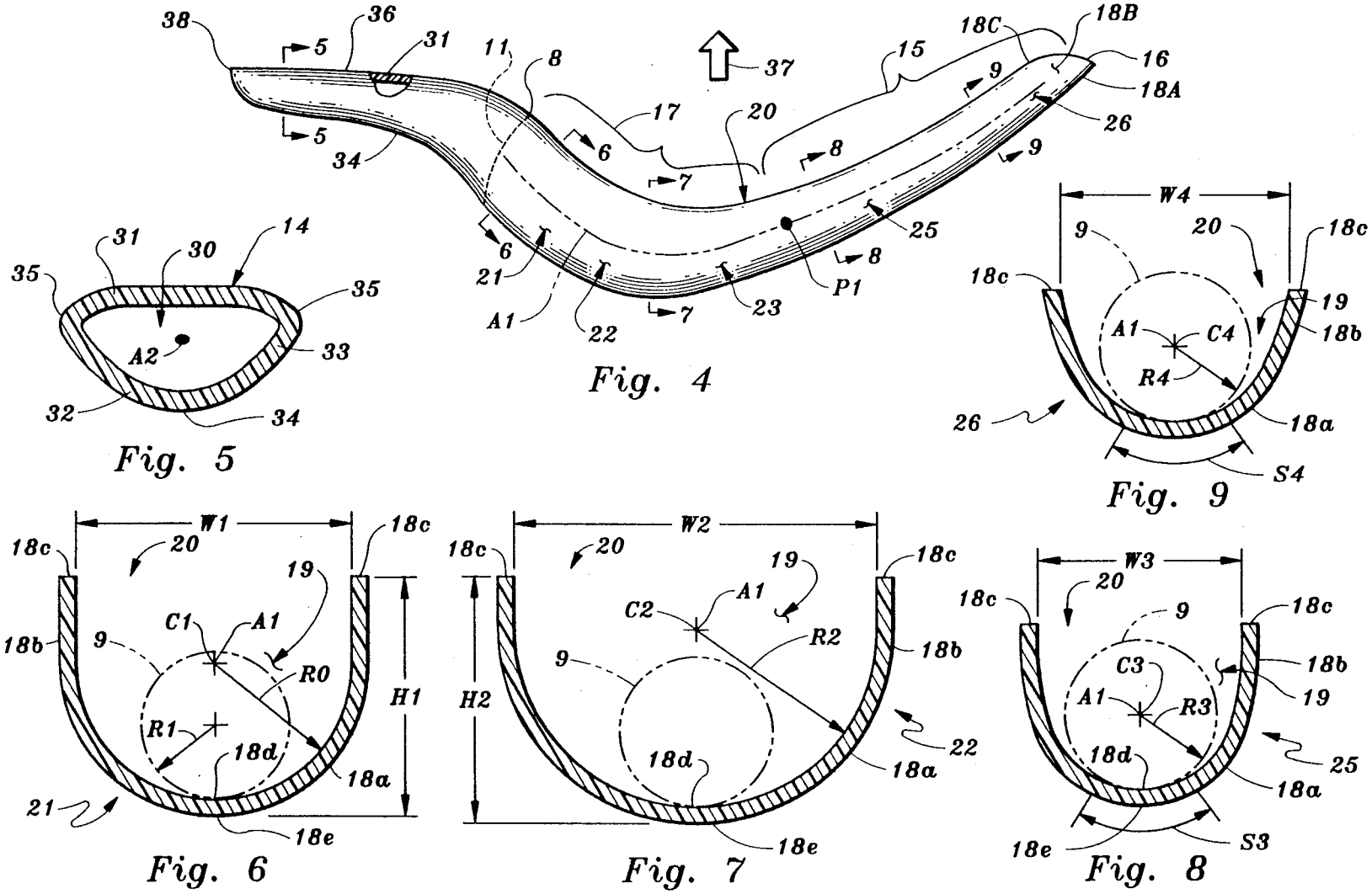
FIG. 4 is a true side view of the scoop, slightly enlarged, of the invention minus the hand of the user of FIGS. 1-3.
FIG. 5 is a section of the handle segment taken along line 5—5 of FIG. 4.
FIGS. 6 and 7 are transverse sections of the pocket section of the receptacle segment taken along lines 6—6 and 7—7, respectively of FIG. 4.
FIGS. 8 and 9 are transverse sections of the up-sloped section of the receptacle segment along lines 8—8 and 9—9, respectively of FIG. 4.

As shown in FIGS. 6–9, the curved floor 18*a* is defined in the transverse direction by a series of formation centers as follows: a center C1 of radius RO (FIG. 6), a center C2 of radius R2 (FIG. 7), a center C3 of radius R3 (FIG. 8) and a center C4 of radius R4 (FIG. 9), all transverse of and coincident with longitudinal axis A1. The curved floor 18*a* of the pocket section 17 is shown in FIGS. 6 and 7, while the same floor 18*a* of the up-slope section 15 is depicted in FIGS. 8 and 9.

Now in more detail, note that formation centers C1 and C2 (FIGS. 6 and 7) relate to the pocket section 17 in the following fashion, viz.,center C1 relates to reverse-sloped segment 21 of the pocket section 17 of FIG. 4. Similarly, center C2 relates to bowl segment 22 of the pocket section 17 of FIG. 4. The pocket section 17 of FIG. 4 also includes an initializing segment 23 integrally connected to the bowl segment 22. The initializing segment 23 is joined with up-slope section 17 at a transverse plane coincident with point P1.

Returning to FIG. 6, note that the reverse-sloped segment 21 of pocket section 17 includes height H1 measured from the upper edge 18*c* to the apex region 18*e* of the floor 18*a* is about 3 times R1 where R1 is the radius of the ball 9. Similarly, as shown in FIG. 7, height H2 (associated with bowl segment 22 annd measured from the upper edge 18*c* to the apex region 18*e* of the floor 18*a* is also about 3 times R1 where R1 is the radius of the ball 9 i.e., H1=H2. The side wall 18*b* heights associated with the initializing segment 23 (not shown) as well as the remainder of the up-sloped section 15 extending from the segment 23, progressive decrease until the tip region 16 is reached.

Radii of the transverse formation centers of the reverse-sloped segment 21 and bowl segment 22 change from a maximum at the center of formation C2 of the bowl segment 22 (FIG. 7) to a minimum radius R3, R4 at the center of formations C3, C4 of the up-sloped section 15 (FIGS. 8 and 9). In FIG. 6, the center C1 of the reverse-sloped segment 21 has a radius RO that is greater than the radius of the ball 9 so that capture of the ball 9 within the reverse-sloped segment 21 is by change in momentum of the ball 9 as the latter encounters the reverse slope of segment 21.

The radius R2 of the center of formation C2 associated with the bowl segment 22 is larger than the radius RO of the center of formation C1. Hence contact with ball 9 within the bowl segment 22 is point contact as it is within the segment 21. Capture within the pocket section 17 then occurs by change in angle of encounter that dynamically occurs between the floor 18*a* and the ball 9 as the latter rolls up the reverse incline of the reverse-sloped segment 21.

Now with regard to the up-slope section 15, note that formation centers C3 of radius R3 and C4 of radius R4 (FIGS. 8 and 9) relate as follows, viz., center C3 and radius R3 relate to a transition segment 25 of FIG. 4. Such segment 25 is seen to be longitudinally positioned adjacent to the point P1 of FIG. 4 that demarks the up-sloped section 15 from the pocket section 17). The center C4 and radius R4 relate to an entry segment 26 of the up-sloped section 15 and is longitudinal positioned adjacent to the tip 16.

Returning to FIG. 8, note that the transition segment 25 of the up-slope section 15 includes side walls 18*b* having a height such that the upper edge 18*c* relative to the apex region 18*e* is slightly greater than about 2 times R1 where R1 is the radius of the ball 9. But referring to FIG. 9, the side wall 18*b* of the entry segment 26 defines a height between upper edge 18*c* relative to the nadir region 18*d* that is slightly less than 2 times R1 where R1 is the radius of the ball 9. Also the width W4 of the entry segment 26 between edges 18*c* is larger than width W3 of the transition segment 25 of FIG. 8. Hence, the ball 9 has a better chance of entry into the up-sloped section 15 because of the width W4.

In similar fashion, the steepness of the wall 18*b* of the transition segment 25 prevents the ball 9 from climbing out from such segment 25 as does similar steepness construction in the wall 18*b* of the bowl segment 22 and of the reverse-sloped segment 21 of the pocket section 17. Moreover, the bowl segment 22 also has enlarged width W2 that allows manipulation to stop the momentum of the ball 9 exiting from the transition segment 25.

The width W2 of the bowl segment 22 relates to the widths of the entry segment 26, the transition segment 25 and the reverse sloped segment 21 as follows:

$$W2 > W1 > W4 > W3$$

where

W2 is the width of the bowl segment 22,
W4 is the width of the entry segment 26,
W3 is the width of the transition segment 25,
W1 is the width of the reverse sloped segment 21.

Note that the width W4 of the entry segment 26 between edges 18c is larger than width W3 of the transition segment 25 of FIG. 8 to ease initial entry but less than the width W1 of the reverse-sloped segment 21.

However, the radii of the formation centers C3, C4 of the transition and entry segments 25, 26 do not change substantially, that is, the radius R4 of the entry segment 26 is about equal to radius R3 of the transition segment 25. As shown in FIG. 8, the radius R3 of the transition segment 25 is slightly larger than the radius R 1 of the ball 9 so that contact between the ball 9 and the floor 18a is along sector S3. The sector S3 has an included angle of about 50 degrees.

Similarly, as shown in FIG. 9, the radius R4 of the entry segment 26 is also slightly larger than the radius R1 of the ball 9 so that contact between the ball 9 and the floor 18a is along sector S4 where S4=S3.

FIG. 5 shows the handle segment 14 in more detail. As shown, the handle segment 14 is hollow and has an interior cavity 30 of triangular cross section measured in the transverse direction. The cavity 30 is symmetrically formed about axis of symmetry A2 terminating in a top wall 31 and sloping side walls 32, 33 meeting at a second apex 34. The side walls 32, 33 transversely extend and are slightly curved relative to the axis A2. The top wall 34 attaches to side walls 32, 33 at corners 35.

The handle segment 14 is oriented with respect to entryway 20 in the following specifics as shown in FIG. 4. An upper surface 36 of the top wall 34 face in a common direction say along arrow 37. The second apex 34 is seen to protrude in a direction opposite to arrow 37.

Height of handle segment 14 measured from the upper surface 36 of the top wall 31 to apex 34 progressively increase from its terminating tip 38 to its connecting end bulkhead 11 of the receptacle segment 13. But the lateral width of the wall 31 remains substantially constant in value during such progression (see FIG. 3).

Note that the shape of handle segment 14 permits the user to emulate a throwing motion during use of the scoop 10 of the invention. As shown in FIGS. 1–3, palm 40 is placed so that the apex 34 of the handle segment 14 is along the longitudinal axis 39 of his hand 41; the palm 40 and the entryway 20 of the scoop 10 face in the common direction, say in the direction of arrow 50 of FIG. 2, and the back 49 of his hand 40 faces in a direction opposite to arrow 50. The index and middle fingers 43, 44 are placed on opposite sides of the apex 34. The ends of the thumb 45 and remaining fingers 46, 47 of the hand 41 end up in contact with the relatively flat surface 36 of the handle segment 14 as shown. In that way, the grip of a baseball pitcher's fingers on the seams of a baseball is emulated wherein the pronation efficiency of the wrist 46 is utilized to allow the user to throw and catch a ball with increased flexibility and accuracy.

That is, the position of the index and middle fingers 43, 44 of the hand 41 (about the handle segment 14) resemble in the gripping position of a baseball pitcher's fingers on the seams of a baseball when the latter is attempting to throw a fastball (or split finger fastball) wherein wrist 46 has maximum pronation or flex. This permits the user of the scoop 10 of the invention to throw and catch a ball with increased flexibility. Hence it is relative easy for an unskilled person to throw ball 9 of FIGS. 8–9 against a wall using the scoop 10 of the invention.

While catching the ball 9 requires increased skill and dexterity, the increased flexibility provided by the manner in which the scoop 10 of the invention is gripped by the user allows him to learn such skill in a short period of time. This is especially true if the user has had previously experience in games emphasizing hitting a ball with a racket such as found in tennis and racketball.

Figure 10:
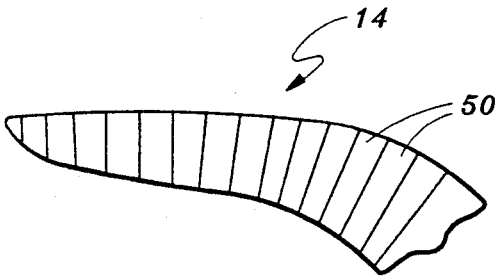
FIG. 10 is a detail in side elevation of the handle segment of FIGS. 1-3 in which a non-slip material has been added.

To insure a firm grip, the handle segment 14 can be overlaid with a relatively thin band of a suitable non-slippery material 50 as shown in FIG. 10. Such material 50 can be fabric, rubber or the like and is attached to a suitable adhesive by winding such material 50 about the handle segment 14.

The ball 9 used in conjunction with scoop 10 of the invention should possess a good elasticity to be able to rebound from a wall after it is thrown against it. A conventional all-purpose rubber racketball is entirely satisfactory.

As previously mentioned, the height of the upper edges 18c relative to the nadir region 18d of the floor 18a changes as a function of progression from the up-slope segment 15 toward the pocket segment 17 as set forth in conjunction with FIGS. 6–9. Assume in this regard that the ball 9 shown is a conventional racketball. In the up-sloped section 15 adjacent to the tip region 16, the diameter 2R1 of the ball 9 is seen to be greater than the height of the up-sloped segment 15 over much of its length. But at the intersection of the up-sloped section 15 and pocket section 17, the diameter 2R1 of the ball 9 is about equal to the depth of the cavity 19.

However, in the pocket section 17 adjacent to the up-sloped section 15, the depth of the cavity 19 is greater than the diameter 2R1 of the ball. Such depth remains in the reverse-sloped segment 21 further up-slope along the pocket section 15.

It will be apparent from the foregoing description that various modifications can be made to the invention by those skilled in the art without departing from the spirit or scope of the claims which follow. For example, the handle segment 14 can be of solid construction in which the outer surface is of a triangular shape similar to that shown in FIG. 5. Also the cross section of the handle segment 14 could be varied to include other cross sectional shapes, such a tetragonal, pentigonal etc. cross sections so long as the user's index and middle fingers could be placed on the sides about an intersection to permit forward pronation of the user's wrist in the manner previously shown.

What is claimed is:

1. A ball tossing and catching scoop comprising a longitudinally extending receptacle member and a handle member connected to said receptacle member, said receptacle member including a remotely positioned sloped section and a pocket section integrally connected to said sloped section, said receptacle member resembling a crescent in side elevation but wherein ball tossing and catching functions are confined to said sloped and pocket sections of said receptacle member only, said sloped and pocket sections being U-shaped in transverse cross section to define a cavity and entryway thereto to catch and throw a ball, said handle member including a wall means having an outer surface of angulated cross section defining a longitudinally extending apex oriented with respect to said entryway of said sloped and pocket sections of said receptacle member such that said apex and said entryway face in opposite directions with respect to each other whereby increased flexibility in usage of said scoop is achieved, said sloped and pocket sections of said receptacle member also including a floor and side walls connected to said floor, said side walls extending transversely to terminating upper edges coincident with said entryway, said floor being curved and including a nadir region at its interior and an apex region at its exterior, both said nadir and apex regions being concave with respect to said entryway, said upper edges of side walls defining a series of width values W measured transversely across said entryway wherein a maximum value is provided at said pocket section, said pocket section also including a reverse-slope segment, a bowl segment and an initializing segment joined integrally end-to-end longitudinally together, said sloped section also including a transition segment and an entry segment joined integrally end-to-end longitudinally together, said transition segment of said sloped section integrally connected to said initializing segment of said pocket section wherein said series of width values W defined across said entryway of said receptacle member relate in accordance with $$W2 > W1 > W4 > W3$$

where

W2 is the width of said bowl segment,

W4 is the width of said entry segment,

W3 is the width of said transition segment,

W1 is the width of said reverse sloped segment.

2. The scoop of claim 1 in which said bowl segment of said pocket section is connected between said initializing segment and said reverse-sloped segment of said pocket section.

3. The scoop of claim 2 in which said entry segment of said sloped section includes a tip region that is longitudinally opposite to said handle member and wherein said entry segment is connected to said transition segment thereof.

4. The scoop of claim 3 in which said side walls of said entry segment of said sloped member are outwardly tapered relative to said floor to better accept a ball entering therein through said entryway thereof.

5. The scoop of claim 3 in which said side walls of said bowl segment of said pocket section are steeply formed relative to said floor to better control a ball residing therein.

6. The scoop of claim 3 in which said side walls of said reverse-sloped segment of said pocket section are steeply formed relative to said floor to better controllably confine a ball residing therein.

7. In a ball tossing and catching scoop, the combination comprising, a longitudinally extending receptacle member and a handle member connected to said receptacle member, said receptacle member including a remotely positioned sloped section and a pocket section integrally connected to said sloped section, said receptacle member resembling a crescent in side elevation but wherein ball tossing and catching functions are confined to said sloped and pocket sections of said receptacle member only, said sloped and pocket sections being U-shaped in transverse cross section to define a cavity and entryway thereto to catch and throw a ball, said handle member including a wall means having an outer surface of angulated cross section defining a longitudinally extending apex oriented with respect to said entryway of said sloped and pocket sections of said receptacle member such that said apex and said entryway face in opposite directions with respect to each other, a user having a hand for forming a grip about said handle member, said hand also including a longitudinally extending axis, a palm, a wrist bisected by said axis and a series of digits extending from said palm, said palm and said digits being placed on said handle member so that said palm and said entryway of said receptacle face in a common direction and said palm contacts said longitudinally extending apex of said wall means of said handle member along said longitudinally axis whereby pronation efficiency of said wrist is promoted to better throw and catch a ball within said receptacle member, said wall means of said handle member being of a transverse triangular cross section defining first, second and third surfaces oriented such that said first surface defines a longitudinal plane that is coextensive of and project in close proximity to said entryway and said second and third surfaces are angled from said longitudinal plane and contact each other to form said longitudinally extending apex oriented with respect to said entryway wherein said grip includes the placement of adjacent digits of said hand of said user in surface contact with said second and third surfaces to substantially emulate that of a baseball pitcher's fingers on the seams of baseball.

8. The combination of claim 7 in which said adjacent digits of said hand of said user is an index finger and a middle finger whereby said grip substantially emulates that of a baseball pitcher on the seams of a baseball to throw a fastball.

9. The combination of claim 8 in which said digits also include a thumb, third and fourth fingers placed in contact with said first surface to permit said user to throw and catch a ball with increased flexibility and accuracy.

10. In a ball tossing and catching scoop, the combination comprising a ball of good elasticity having a radius R1, a longitudinally extending receptacle member and a handle member connected to said receptacle member, said receptacle member including a remotely positioned sloped section and a pocket section integrally connected to said sloped section, said receptacle member resembling a crescent in side elevation but wherein ball tossing and catching functions are confined to said sloped and pocket sections of said receptacle member only, said sloped and pocket sections being U-shaped in transverse cross section to define a cavity and entryway thereto to catch and throw a ball therein, said handle member including a wall means having an outer surface of angulated cross section defining a longitudinally extending apex oriented with respect to said entryway of said sloped and pocket sections of said receptacle member such that said apex and said entryway face in opposite directions with respect to each other whereby increased flexibility and accuracy in catching and throwing said ball is achieved, said sloped and pocket sections of said receptacle member also including a floor and side walls connected to said floor, said side walls extending transversely to terminating upper edges coincident with said entryway, said floor being curved and including a nadir region at its interior and an apex region at its exterior, both said nadir and apex regions being concave with respect to said entryway, said curved floor of said sloped and pocket sections of said receptacle member relative to said entryway, defining a series of transverse formation centers C longitudinally extending said sloped and pocket sections, said formations centers C defining a series of radii R relative to said radius Ri of said ball wherein said radii R of said formation centers are always equal to or greater than R1, said pocket section also including a reverse-slope segment, a bowl segment and an initializing segment joined integrally end-to-end longitudinally together and in which said sloped section also includes a transition segment and an entry segment joined integrally end-to-end longitudinally together, said transition segment of said sloped section integrally connected to said initializing segment of said pocket section wherein a series of height values H are defined between said upper edges of said side walls and said nadir region of said floor that relate to said radius R1 of said ball, said bowl segment of said pocket section defining a height value H2 equal to 3 times R1 where R1 is the radius of said ball.

11. The combination of claim 10 in which said reverse-slope segment of said pocket section defines a height value H1 equal to 3 times R1 where R1 is the radius of said ball.

* * * * *